United States Patent [19]

Levin

[11] 4,053,243

[45] Oct. 11, 1977

[54] LIQUID APPLICATOR

[76] Inventor: David Levin, 10, Hope Road, Mountainview, Johannesburg, South Africa

[21] Appl. No.: 636,418

[22] Filed: Dec. 1, 1975

[30] Foreign Application Priority Data

July 24, 1975 South Africa ..... 75/4767

[51] Int. Cl.[2] ..... B43M 11/06; B43K 5/00

[52] U.S. Cl. ..... 401/186; 401/202; 401/205; 401/133

[58] Field of Search ..... 401/183.6, 205, 206, 401/202, 132, 133

[56] References Cited

U.S. PATENT DOCUMENTS

| | | | |
|---|---|---|---|
| 2,048,689 | 7/1936 | Feasel | 401/205 |
| 2,281,105 | 4/1942 | Marti et al. | 401/205 X |
| 2,853,727 | 9/1958 | Nada | 401/202 |
| 3,023,448 | 3/1962 | Fagan | 401/202 |
| 3,129,452 | 4/1964 | Schwartzman | 401/206 |
| 3,133,309 | 5/1964 | Miles | 401/202 X |
| 3,482,920 | 12/1969 | Schwartzman | 401/132 |

FOREIGN PATENT DOCUMENTS

| | | | |
|---|---|---|---|
| 1,381,680 | 11/1964 | France | 401/133 |

*Primary Examiner*—Stephen C. Pellegrino
*Attorney, Agent, or Firm*—Lowe, King, Price & Markva

[57] ABSTRACT

This invention relates to a liquid applicator for applying a cleaning liquid. The applicator comprises a bottle, a container within the neck of the bottle containing a pad of polyurethane foam and a support structure which is attached to the body. A covering of woven synthetic material is welded to the support structure and is substantially unsupported over its main portion. The cleaning liquid passes through the foam material which causes it to froth and the frothed liquid passes in turn through the woven synthetic material to be applied easily to the material to be cleaned.

9 Claims, 3 Drawing Figures

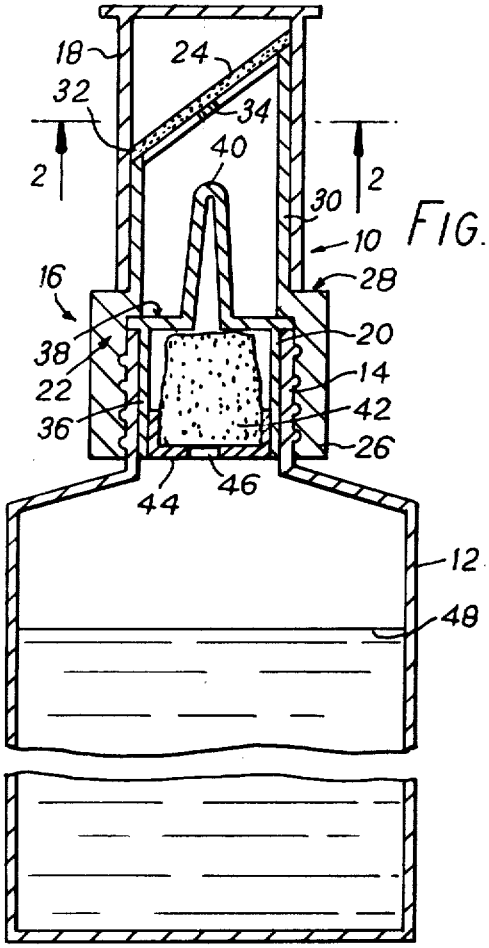
FIG. 1
FIG. 3
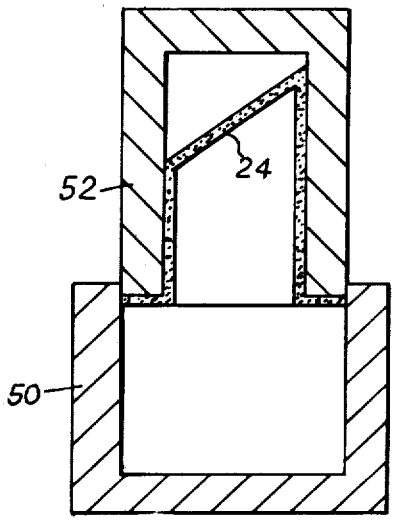
FIG. 2
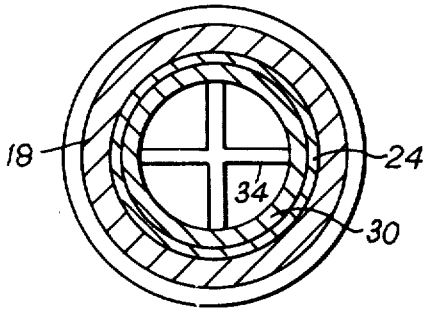

LIQUID APPLICATOR

BACKGROUND TO THE INVENTION

This invention relates to liquid applicators.

This invention is concerned with a liquid applicator of the kind in which a liquid is caused to pass from a reservoir to be applied to a surface. Such a liquid applicator will hereinafter be referred to as an applicator of the kind set forth.

One known applicator of the kind set forth comprises a foam pad through which the liquid passes and the outer surface of the pad is used to apply the liquid to the surface. Such an applicator suffers from a number of disadvantages and, to my knowledge, has been used to-date only for applying white cleaner to tennis and cricket shoes. Another applicator of the kind set forth comprises a rigid support such as a cork or tin with a material cover therefor. The rigid support has a small central opening through which the liquid can pass. With such an applicator, the liquid can only reach the material at the location of the opening, which is normally located in the center of the rigid support and must be diffused through the material from this central location. It is an object of the invention to provide an applicator which has good wear characteristics and provides adequate control of liquid to its surface.

SUMMARY OF THE INVENTION

According to one aspect of the present invention there is provided a liquid applicator comprising a body, a liquid reservoir within the body, a pad of restrictor material within the body which material allows limited amounts of liquid to pass therethrough, a wear resistant cover member through which the liquid can pass and a liquid flow passage leading from the reservoir through the restrictor and hence to the cover members.

The restrictor material may comprise any suitable material such as foamed plastic, foamed rubber or cotton wool. Preferably the pad material comprises a foamed polyurethane which allows limited amounts of liquid therethrough. The pad is preferably contained in a chamber spaced from the cover and having a narrow outlet therefrom. The cover preferably comprises a woven material and in particular a woven synthetic material such as a polyester such as "Terylene" or polypropylene. The cover is preferably welded on to a support structure which is substantially wholly open.

According to another aspect of the invention, there is provided a closure device for a bottle to convert the latter to an applicator. The closure device comprises a support structure which has an outlet face that is substantially open and which has means whereby it may be attached to a bottle. A cover is carried by the support structure and provides an applicator surface that lies over and is substantially unsupported by the outlet face of the support structure. The closure preferably includes a restrictor unit for use therewith. The restrictor unit comprises a chamber containing a restrictor such as a pad of foamed plastic, foamed rubber or cotton wool. The chamber preferably has a restricted outlet and preferably also a restricted inlet.

According to a further aspect of the invention there is provided a method of making a closure device set out in the preceding paragraph wherein the support structure comprises a plastics material and the cover comprises a woven synthetic material. The method comprises applying the woven material to the support structure and then applying ultrasonic vibrations to the support structure so as to weld the cover to the support structure.

BRIEF DESCRIPTION OF THE DRAWINGS

An embodiment of the invention will now be described with reference to the accompanying drawings.

In the drawings:

FIG. 1 is a sectional view through a liquid applicator of the invention,

FIG. 2 is a section on line 2 — 2 of FIG. 1, and

FIG. 3 is a diagrammatic sectional side view through apparatus for welding the cover to the supporting structure.

DESCRIPTION OF PREFERRED EMBODIMENT

Referring now to FIG. 1, there is shown an applicator 10 of the invention. The applicator comprises a flexible, moulded plastics bottle 12 forming a liquid reservoir as will become apparent The bottle 12 has a reduced diameter neck 14 on to which is screwed a closure device 16. A cap 18 covers the closure device 16. A restrictor unit 20 is received within the neck 14 as will be described.

The closure device 16 comprises a moulded plastics support structure 22 formed of polypropylene and a cover 24. The support structure 22 has a cylindrical base part 26 forming a mouth which is internally threaded so as to be threaded on to the neck 14 of the bottle 12. At the upper end of the base part 26 there is an inward step 28 and then a further cylindrical part 30 cut off at its upper end 32 at an angle of about 30° to its axis. A narrow cross part 34 spans the open end 32.

The cover 24 comprises a woven polypropylene cloth. This cloth is draped over the cylindrical part 30 and is welded ultrasonically thereto as will be described, having its outer edges resting on the step 28. It will be noted that the cover 24 is substantially unsupported in the area between the walls of the part 30, the cross part 34 comprising only a small portion of this area.

The restrictor unit 20 comprises a cylindrical body 36 which fits the neck 14 and which has a flanged substantially closed top end 38. A narrow tube 40 runs from the center of the top end 38. Initially the end of the tube 40 is closed off, but before the applicator is used the end of the tube 40 is cut off to allow liquid to pass therethrough. Within the body 36 there is a pad or plug 42 of synthetic sponge material formed e.g. from foamed polyurethane incorporating a polyester resin. A cylindrical cup 44 having a small central orifice 46 fits the body 36 to close off its open end.

The bottle 12 is filled with a liquid 48 comprising a water based formulation containing an ionic detergent with a builder and a low boiling point ketone and alcohol fractions. This liquid, may pass along the liquid flow passage from the reservoir 12 to the cover material 24 through the restrictor 20. As the liquid passes through the restrictor unit 20, it froths and the froth or foam passes out through the cover material 24. The liquid can then be used to clean stained materials.

In use, with the end of the tube 40 cut off, the bottle 12 is shaken and squeezed to force the liquid through the restrictor and hence through the cover 24. The liquid is applied to a strained material by the cover and the cover can be rubbed over the material and will float off the stain.

The cover 24 is applied to the support structure 22 as follows: The cylinder base 26 is received in a jig member 50. The polypropylene cloth 24 is draped over the cylindrical part 30. A cylindrical horn 52 is then applied to the cylindrical part 30. The horn has an ultrasonic vibration applied thereto. These vibrations cause the cover material 24 to be welded to the support structure and cut off the excess cover material.

I have found that, in addition to restricting the amount of liquid being dispensed when the bottle is squeezed, the restrictor 20 prevents liquid running out of the bottle when it, the bottle, is inverted. The restrictor 20 also breaks down the size of the bubbles of the froth.

Further I have found that the cover material 24 is hardy and stands up to considerable wear and abrasion. It also has abrasive properties which enable it to assist in the cleaning operation of the device.

The invention is not limited to the precise constructional details hereinbefore described and illustrated in the drawings. For example, the bottle may be formed with two chambers in one of which is received the liquid and in the other is a pad of foam material or the like to act as the restrictor.

The cover may be shaped by heating and its surface may be singed which will have the effect of hardening the material as well as making the surface thereof more abrasive. A wick may be provided leading in from the liquid to the restrictor to maintain the latter always damp.

I claim:

1. A liquid applicator comprising:

a. a liquid reservoir, b. flow restrictor means having an inlet communicating with the reservoir and an outlet, c. said flow restrictor means being effective to receive liquid from the liquid reservoir through said inlet, produce foam and direct said foam through said outlet, d. a foam flow passage means extending outwardly from the flow restrictor means and having an open outer end, and e. wear resisting cover means disposed over the outer end of the foam flow passage means and being porous to the flow of foam therethrough, f. said foam flow passage means comprising a hollow elongated outlet support member extending between the flow resistor means and the cover means to form a foam chamber in which the passage of liquid foam is guided from the outlet of the flow restrictor means to the cover means, g. said flow restrictor means including a restrictor material effective to permit liquid in foam form to pass therethrough.

2. An applicator as defined in claim 1 wherein the restrictor material comprises foamed material.

3. An applicator as defined in claim 1 wherein said resistor material comprises cotton wool.

4. An applicator as defined in claim 1 wherein the cover means comprises a woven synthetic material welded onto an outside surface of the outlet support member.

5. An applicator as defined in claim 1 wherein the liquid reservoir contains an ionic detergent which foams when passed through the flow restrictor means.

6. An applicator as defined in claim 1 wherein the reservoir comprises a flexible material so that it may be squeezed manually.

7. An applicator as defined in claim 1 wherein the cover means comprises a cover member that overlies the outer end of the foam flow passage means and is substantially unsupported over a substantial portion of said cover member.

8. An applicator as defined in claim 1 wherein the flow restrictor means has an elongated restricted outlet part extending into said foam chamber.

9. A closure combination for a bottle to convert the bottle into an applicator, said closure device comprising:

a. a support structure having an outlet face at its outer end that is substantially open and including means for attachment to a bottle, b. cover means carried by the support structure and providing an applicator surface, c. said cover means lying over and being substantially unsupported by the outlet face of the support structure, and d. a flow restrictor means laterally spaced from the outer end of the support structure to form an elongated foam flow passage chamber between the flow restrictor means and said outer end, e. said flow restrictor means including a restrictor material effective to permit liquid in foam form to pass therethrough into said foam flow passage chamber.

* * * * *